United States Patent [19]

Travor

[11] 3,972,288

[45] Aug. 3, 1976

[54] PYROFUZE ARRANGEMENT

[75] Inventor: Bruce W. Travor, Holland, Pa.

[73] Assignee: The United States of America as represented by the Secretary of the Army, Washington, D.C.

[22] Filed: Oct. 29, 1974

[21] Appl. No.: 518,426

[52] U.S. Cl. ..... 102/70 R; 102/27 R

[51] Int. Cl.[2] ..... C06C 5/00

[58] Field of Search ..... 102/27, 70

[56] References Cited

UNITED STATES PATENTS

| | | | |
|---|---|---|---|
| 3,289,583 | 12/1966 | Silverman | 102/20 |
| 3,336,869 | 8/1967 | Peterson et al. | 102/27 |
| 3,665,858 | 5/1972 | Travor | 102/27 |
| 3,734,019 | 5/1973 | Rentz et al. | 102/27 |

*Primary Examiner*—Verlin R. Pendegrass

*Attorney, Agent, or Firm*—Nathan Edelberg; Robert P. Gibson; William Sommer

[57] ABSTRACT

A spool wrapped with a covered fuze delay wire in which accurately predictable delays are obtainable and adverse relative or slippage motion between the wire and the spool flanges is precluded, especially during operative burning of the wire. The fuze wire passes through and is secured to the spool flanges by means of heat shrunk tubing elements abutting the opposed faces of each spool flange and containing a silicone rubber strip in which are embedded uncovered wire portions. The heat shrunk tubing is of silicone rubber material to insulate the uncovered wire portions from the spool.

4 Claims, 3 Drawing Figures

PYROFUZE ARRANGEMENT

The invention described herein may be manufactured, used and licensed by or for the Government for governmental purposes without the payment to me of any royalty thereon.

This invention relates to burnable fuze arrangements, and more particularly to a Pyrofuze wire delay element.

In the development of fuze wire delay elements, the covering has been secured to a mechanical apparatus, but this did not prevent the wire from moving or slipping relative to the mechanical apparatus to produce in accurate operations.

It is an object of the invention to provide a fuze arrangement in which accurately predictable delays are obtainable.

Another object of the invention is to provide such an arrangement in which slippage between the wire and its spool securing means is substantially precluded.

A further object of the invention is to provide such an arrangement in which adverse environmental heat sink effects are precluded.

These and other objects, features and advantages will become more apparent from the following description and accompanying drawings in which.

Figure 1:
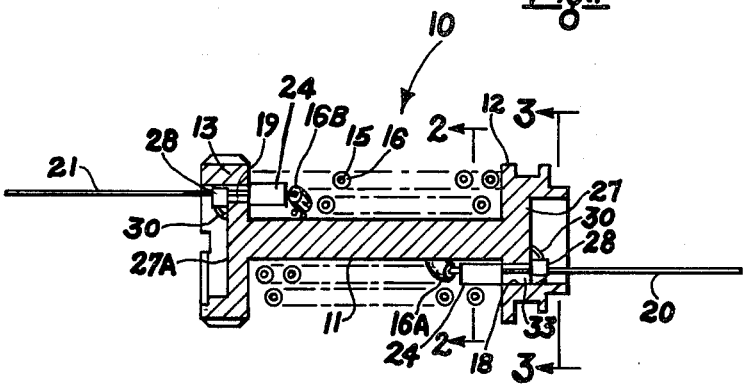
FIG. 1 is a longitudinal sectional view of a preferred fuze delay wire arrangement embodying the principles of the invention.

The fuze delay wire arrangement, shown generally at 10 (FIG. 1), includes a spool 11 having a pair of longitudinally spaced end flanges 12, 13 and an intermediate hub portion about which is spirally wrapped the substantially effective length of a fuze delay wire 15 that is originally contained within a braided fiber glass covering 16. The covering on predetermined lengths of the ends of the wire 15 is removed or stripped for insertion through a corresponding longitudinal passage 18, 19 provided in spool flange members 12, 13 at predetermined locations thereon where the wire 15 is secured as hereinafter described.

The stripped wire ends have portions 20, 21 that extend through the respective flange passages 18, 19 for purposes of interconnecting spaced elements (not shown) of a fuze train that requires an ignition time delay of a predetermined amount as predicted by the effective length and characteristics of the wire 15.

Figure 2:
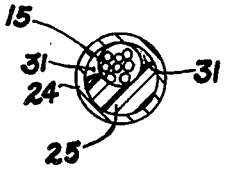
FIG. 2 is an enlarged sectional view taken along line 2—2 of FIG. 1 with certain parts omitted.
Figure 3:
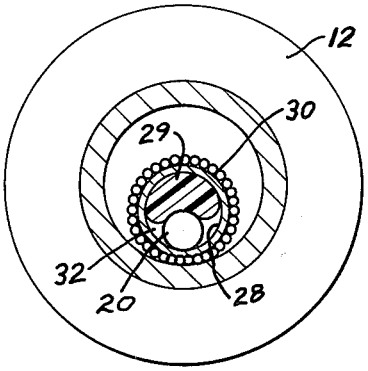
FIG. 3 is an enlarged sectional view taken along line 3—3 of FIG. 1.

In the securement of the wire to the spool flanges about an inch of covering is stripped or removed from each end of the wire, with an appropriate protected tape (not shown) being utilized on the covering to permit a neat severance thereof at 16A, 16B. A predetermined length of heat shrinkable tubing 24 (FIGS. 1, 2) of silicon rubber material is slid over the free end of wire portion 20 (prior to its insertion through flange passage 18) to a position closely adjacent cover severance 16A. A silicone rubber strip 25 (FIG. 2) of substantially equal length as tubing 24 is slid within the tubing, and heat is applied to tubing 24 for shrinking thereof and firmly securing a predetermined stripped portion of wire 15 therewithin and partially embedded in strip 25. The stripped wire end portion 20 is inserted through flange passage 18 (that preferably intersects with a cylindrical recess 27 provided in the outer face of spool end flange 12), with the heat shrunk tubular member 24 in abutment with the inner surface of spool end flange 12. A shorter but similarly mounted heat shrunk tubular member 28 (FIGS. 1, 3), containing a similar silicone rubber element or strip 29 (FIG. 3) clamping therewithin another stripped portion of wire 15, is secured to an outer spool surface or its recess base 27 in an abutting relationship, with an annular bead of vulcanized rubber sealant 30 applied around the base of the shrunk on tubing 28 to secure the tubing in position and seal off the spool passage 18 externally of the tubing 28. The stripped wire end portion 20 is thus firmly secured to the spool flange 12 by insulating tubular members 24, 28 that contain corresponding longitudinal air passages 31, 32 which fluidly communicate with the air space 33 surrounding the stripped taut wire extending through spool passage 18.

The stripped wire end portion 21 is similarly secured to spool flange 13 adjacent spool passage 19 and flange recess 27A, with like reference numerals denoting similar elements of structure as utilized in the fuze delay wire securement to spool flange 12.

Various modifications changes or alterations may be resorted to without departing from the scope of the invention as set forth in the appended claims.

I claim:

1. In a spool wrapped with a covered fuze delay wire, said spool having a pair of longitudinally spaced end flange portions and an intermediate hub portion, each of said flange portions having a longitudinal passage, said fuze wire having portions of uncovered ends extending through a corresponding one of said passages, a heat shrunk tubing member secured to a corresponding uncovered portion of each wire intermediate the covered wire portion and the respective uncovered wire end portions, said tubing member containing a corresponding silicone rubber strip securing the respective uncovered wire portions within said tubing member, each of said tubing members being in abutment with a corresponding inner surface of one of said spool end flanges, a heat shrunk tubular member secured to corresponding ones of said uncovered end portions of said wire and containing a corresponding silicone rubber element, securing the respective uncovered end portions within the corresponding tubular member, each of said tubular members being in abutment with a corresponding outer surface portion of one of said spool end flanges, and means surrounding each of said heat shrunk tubular members and sealing said corresponding passages externally of said corresponding tubular members.

2. The structure in accordance with claim 1 wherein peripheral portions of each of said secured uncovered wire portions are embedded in the corresponding silicone rubber means to define longitudinal air space means through each heat shrunk member.

3. The structure according to claim 2 wherein said uncovered wire portions extending through said spool passages are spaced and insulated from said spool.

4. The structure of claim 3 wherein each of said heat shrunk members is of silicone rubber material.

* * * * *